United States Patent [19]

Glaser et al.

[11] 4,259,814

[45] Apr. 7, 1981

[54] TOOL SHARPENING MACHINE

[75] Inventors: Donald J. Glaser; Harold W. Gaston, both of Emporia, Kans.

[73] Assignee: Glendo Corporation, Emporia, Kans.

[21] Appl. No.: 71,200

[22] Filed: Aug. 30, 1979

[51] Int. Cl.[3] ..... B24B 3/00

[52] U.S. Cl. ..... 51/122; 51/125.5; 51/126; 51/240 A

[58] Field of Search ..... 51/94 R, 121, 122, 125, 51/125.5, 126, 216 A, 216 ND, 216 H, 240 R, 240 A

[56] References Cited

U.S. PATENT DOCUMENTS

| | | | |
|---|---|---|---|
| 238,366 | 3/1881 | Doane | 51/122 |
| 427,477 | 5/1890 | Lawles | 51/122 |
| 970,351 | 9/1910 | Pike et al. | 51/238 R |
| 2,176,726 | 10/1939 | Shepherd | 51/239 |
| 2,565,309 | 8/1951 | Jacoby | 51/92 R |
| 2,589,489 | 3/1952 | Fuhr | 51/240 R |
| 2,974,451 | 3/1961 | Bader et al. | 51/239 |
| 3,054,229 | 9/1962 | Peasley et al. | 51/122 |
| 3,566,550 | 3/1971 | Piccinino | 51/238 R |

FOREIGN PATENT DOCUMENTS

| | | | |
|---|---|---|---|
| 2252549 | 5/1974 | Fed. Rep. of Germany | 51/125 |

*Primary Examiner*—Gary L. Smith
*Assistant Examiner*—Robert P. Olszewski
*Attorney, Agent, or Firm*—Schmidt, Johnson, Hovey & Williams

[57] ABSTRACT

An improved sharpening machine is provided for easy, extremely accurate sharpening of a variety of tools such as lathe, boring and cutting tools. The machine includes a rotatable, low speed, diamond or other abrasive surfaced wheel, and a tool-supporting table mounted for translatory movement along a path parallel to the wheel abrasive face. The table is further mounted for measured tilting thereof relative to the wheel face, and for shifting of the table and associated structure completely clear of the wheel to facilitate certain sharpening operations and wheel replacement. With the table pivoted completely away from the wheel, the cutting wheel can be operated in a plane perpendicular to its original operating plane. A pivotal tool guide is removably secured to the table for selective alteration of the angular position of a tool being sharpened.

5 Claims, 4 Drawing Figures

TOOL SHARPENING MACHINE

BACKGROUND OF THE INVENTION

1. Field of the Invention

The present invention is concerned with an improved tool sharpening machine especially adapted for accurate sharpening operations in connection with a wide variety of cutting and boring tools. More particularly, it is concerned with such a machine which is characterized by ease and accuracy of operation by provision of a rotatable abrasive wheel in conjunction with a selectively tiltable, tool-supporting table which translates along a path parallel to the abrasive wheel. In addition, the table is mounted for shifting thereof completely clear of the abrasive wheel as desired. With the table shifted completely clear of the wheel, the wheel can be operated in a plane perpendicular to its original orientation.

2. Description of the Prior Art

Many cutting tools used in lathes, machine shop equipment, and in other contexts require relatively frequent replacement or resharpening, in order to maintain the accuracy of the tools. In the past, it has been common practice to simply replace worn tools of the replaceable insert type, inasmuch as replacement was more economical than resharpening certain cutting tool inserts. However, the cost of tool inserts has risen dramatically in recent years to the point where it is now economically feasible to resharpen these tools and easily possible to do so with this improved tool sharpening machine.

Free hand tool sharpening is, generally speaking, a relatively quick operation. However, in most instances the free hand method can only rough shape a cutting tool. Free hand sharpening to accurate angles and fine surface finishes demands considerable time and skill, and is therefore expensive. Accordingly, there is a real need for a simplified, relatively inexpensive device which can be used to sharpen tools to accurate angles and good finishes.

SUMMARY OF THE INVENTION

The present invention is concerned with a portable, relatively inexpensive tool sharpening machine which is characterized by ease of operation and extreme accuracy in sharpening of a wide variety of cutting tools. The sharpening machine of the invention includes a rotatable, abrasive wheel (preferably diamond surfaced) which presents a substantially planar tool-engaging face. The wheel is mounted with the tool-engaging face thereof lying in a reference plane, and a substantially planar, tool-supporting table is disposed adjacent the abrasive cutting face and lies in a plane intersecting the reference plane. Means is provided for selective, translatory shifting of the table in the table plane and parallel to the abrasive cutting face, i.e., to the reference plane. In this fashion, a tool can be disposed on the table in engagement with the rotating wheel face, and the table and tool are shifted in unison for accurate sharpening purposes; unintended relative displacement between the table and tool being sharpened is thereby avoided.

In preferred forms, the sharpening machine of the invention also includes structure for selective variation of the angle of intersection between the table and reference planes, so that the table elevation can be selectively set for positive or negative rake or clearance angles. Table elevation is accurately gauged by means of a graduated protractor element mounted for pivotal movement about the axis of rotation of the table itself.

In further preferred forms, the table includes a tool guide pivotally supported on the upper, tool-supporting surface thereof about an axis and intersecting the table plane. Moreover, the table and associated structure are advantageously pivotally coupled to the main machine body by means of a carriage assembly, so that the table can be pivoted completely clear of the abrasive wheel to facilitate replacement thereof or certain types of tool resharpening not reequiring table support. With the table completely pivoted away from the wheel, the machine can be oriented for unobstructed, horizontal wheel operation.

DESCRIPTION OF THE PREFERRED EMBODIMENT

Figure 3:
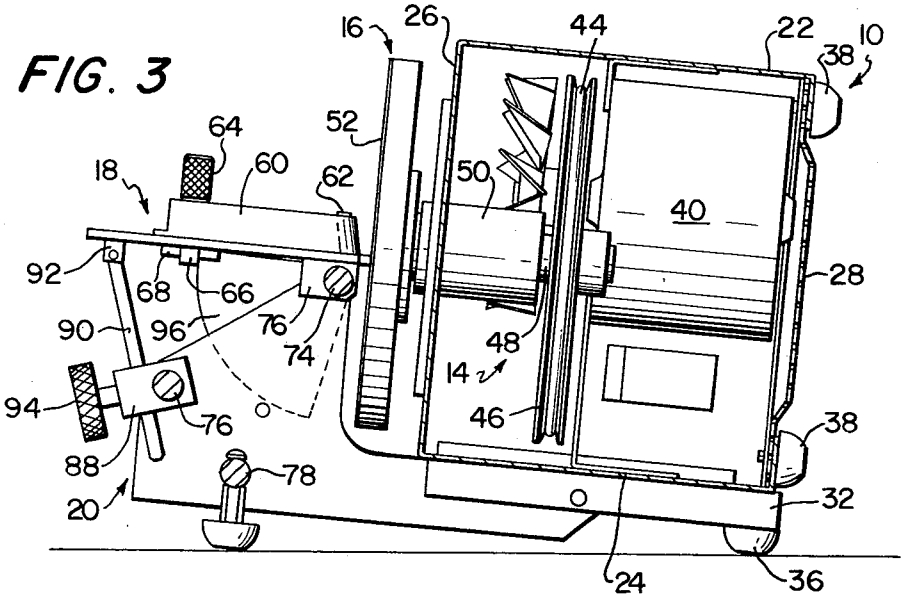
FIG. 3 is a sectional view taken along line 3—3 of FIG. 2.

Turning now to the drawing, a sharpening machine 10 in accordance with the invention is illustrated. Machine 10 broadly includes a generally rectangular housing 12, enclosed motor and drive means broadly referred to by the numeral 14 (FIG. 3), an external, rotatable abrasive wheel 16, a substantially planar, tool-supporting table 18, and structure referred to by the numeral 20 for selective support and shifting of the table 18 as desired.

In more detail, housing 12 includes top and bottom walls 22, 24, front wall 26, a back wall in the form of a screen 28, and respective opposed sidewalls 30.

A pair of spaced, elongated mounting blocks 32, 34 are secured to bottom wall 24, and support respective resilient pads 36. Similarly, four resilient pads 38 are respectively disposed and secured to the corners of screen 28 for purposes which will be made clear.

Motor and drive means 14 include a conventional electric motor 40 controlled by external switch 42. The output of motor 40 is coupled by means of belt 44 to a large pulley 46. Pulley 46 is in turn coupled to a drive shaft 48 which extends through conventional bushing structure 50 and front wall 26. Abrasive wheel 16 is secured to the outermost end of the shaft 48. The motor and drive means 14 is designed so as to rotate wheel 16 at a relatively slow rate (240 RPM), which is advantageous for accurate sharpening operations.

The wheel 16 is conventional and includes an annualar, substantially planar, tool-engaging abrasive face 52. Preferably, the face 52 is diamond surfaced to facilitate accurate sharpening operations.

Table 18 is of generally planar, rectangular configuration, and is provided with an arcuate slot 54 therethrough. A series of graduated markings 56 are also provided on the upper, tool-supporting face of table 18 adjacent the slot 54. A relatively small, rectangular tab-like extension 58 is provided at the left hand end of table 18 as viewed in FIGS. 1 and 4.

An elongated, bar-like tool guide 60 is supported on the upper surface of table 18, and is pivotally and removably mounted thereon by means of a pin 62 extending through the block 60 and into a complemental aperture (not shown) through table 18. The remaining end of guide 60 is provided with a knurled, rotatable locking knob 64 having an elongated shaft 66 extending therefrom. The shaft 66 extends through the outermost end of the guide 60 and through the slot 54; the shaft 66 is connected to an elongated cross pin 68 disposed adjacent the underside of table 18. As will be readily appreciated, knob 64 can be rotated to loosen guide 60 and the latter can be pivoted about the axis defined by pin 62 to a desired position, whereupon the knob can be retightened to lock the guide 60 in place.

Figure 2:
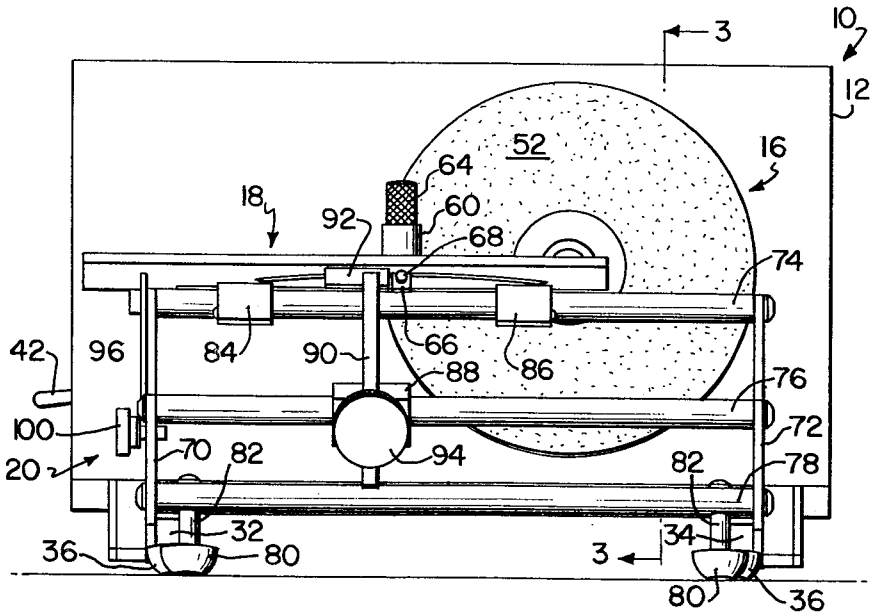
FIG. 2 is a front elevational view of the machine illustrated in FIG. 1.

The structure 20 includes a pair of spaced, opposed, somewhat L-shaped plates 70, 72 which are respectively pivotally coupled to the corresponding adjacent blocks 32, 34 and in effect present a carriage for the table 18 and associated structure. A series of three elongated, rigid bars 74, 76 and 78 extend between the plates 70, 72 as best seen in FIGS. 2 and 3. A pair of ground engaging pads 80 are connected to lowermost bar 78 by means of conventional connectors 82.

A pair of spaced slide blocks 84, 86 are slidably mounted on uppermost bar 74, and are in turn permanently affixed to the underside of table 18. A single slide block 88 is similarly slidably mounted on intermediate bar 76. The block 88 includes an angularly disposed aperture therethrough which slidably receives an elongated, elevation adjustment rod 90. The rod 90 is pivotally coupled at its uppermost end to the underside of table 18 by means of a pivotal mount 92. The position of rod 90 relative to the block 88 is releasably maintained by means of thumb screw 94 which is in operative engagement with the rod 90 within block 88.

Figure 1:
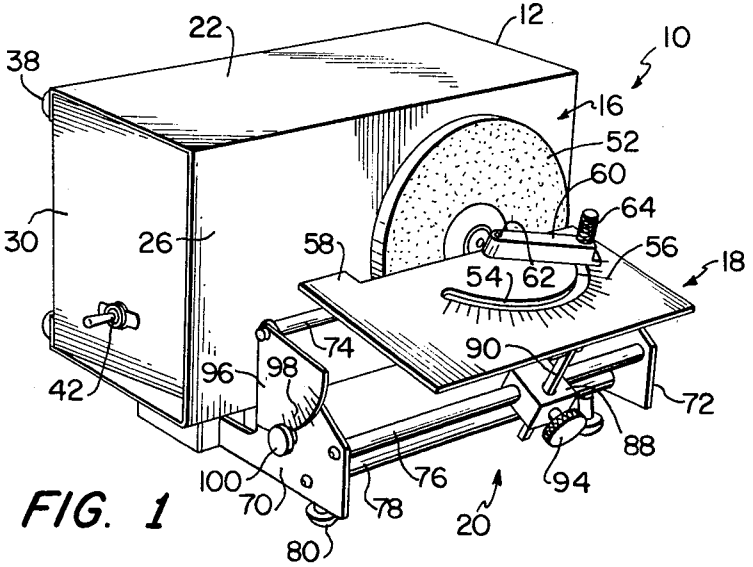
FIG. 1 is a perspective view of a sharpening machine in accordance with the invention.
Figure 4:
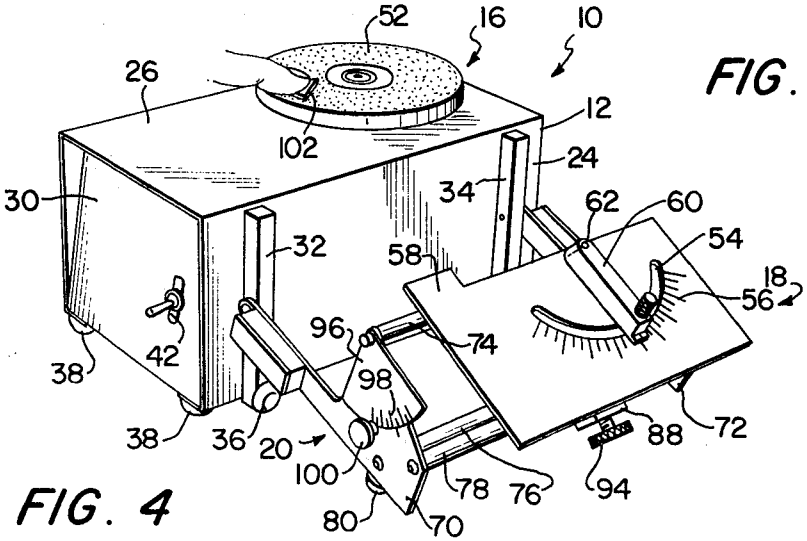
FIG. 4 is a perspective view similar to that of FIG. 1, but illustrating the tool-supporting table and associated structure pivoted clear of the rotatable abrasive wheel.

A substantially sector-shaped, protractor-like table elevation scale 96 is pivoted to the outermost left hand end of bar 74 as viewed in FIGS. 1, 2 and 4. The scale is provided with a series of graduated markings 98, and a conventional thumb screw 100 is mounted in adjacent plate 70 proximal to the arcuate edge of the scale 96 for engaging the latter and maintaining the same in a desired pivoted position.

In order to facilitate a further description of the construction and operation of machine 10, it will be helpful to think of abrasive face 52 of wheel 16 as defining a reference plane, whereas the table 18 can be thought of as lying in a second plane which intersects the reference plane.

When it is desired to use machine 10 in a sharpening operation, table 18 is first elevated to a desired extent so as to position the table plane at a desired angle of intersection relative to the reference plane. This is accomplished by first loosening thumb screw 100 and rotating the protractor-like scale 96 about the axis defined by bar 74 to a desired extent. At this point the thumb screw 100 is retightened to lock the scale 96 in place. The thumb screw 94 is next loosened, and table 18 pivoted upwardly by the axis defined by the bar 74, whereupon the table is shifted leftwardly as viewed in FIG. 1 and lowered to drop onto and engage the uppermost edge of the scale 96 (see FIG. 3). At this point the thumb screw 94 is retightened to lock table 18 in a desired elevation, and thumb screw 100 is loosened to drop the scale 96 safely out of the way.

The next step involves adjustment of tool guide 60, which is accomplished simply by loosening the knob 64 and rotating the tool guide about the upright axis defined by the pin 62, using the markings 56 as a guide. When the desired position is reached, the knob 64 is retightened.

During sharpening operations, an elongated tool (not shown) is placed against the guide 60 in disposition such that the work end of the tool can engage the annular face 52. At this point motor 40 is started in order to commence relatively low speed rotation of wheel 16. Actual sharpening is accomplished by translatory shifting of table 18 and the tool to be sharpened (which is held firmly against guide 60) along the rectilinear path defined by the bar 74. As explained above, this path is parallel to the reference plane or face 52. In this way the entire work surface of the face 52 is employed, and moreover inadvertent relative shifting between the table and tool to be sharpened is avoided. Of course, for jobs that require an unobstructed work table, it is a simple matter to entirely remove the guide 60 from the table 18.

In the event that replacement of wheel 16 is required, or finishing of relatively small points or the like is needed, the entire table 18 and supporting structure therefor can be shifted completely clear of the wheel. Specifically, the carriage assembly cooperatively defined by the plates 70, 72 can be pivoted to the FIG. 2 position simply by grasping the plate 18 and rotating the latter and the supporting carriage structure about the pivots through the spaced blocks 32, 34. In this orientation it will be observed that wheel 16 is completely unobstructed, and is now in a generally horizontal position—a position which is highly desirable for sharpening a variety of tools, such as small point 102.

Having thus described the invention, what is claimed as new and desired to be secured by Letters Patent is:

1. A tool finishing machine adapted to rest on a support surface, comprising:

a housing having first and second opposed, spaced apart sidewalls, and a third sidewall extending between said first and second sidewalls;

a rotatable, abrasive wheel presenting a substantially planar, tool-engaging face;

motive means for said wheel operatively disposed within said housing;

means for rotatably mounting said wheel adjacent said first sidewall and generally parallel thereto, and for operatively coupling said wheel and motive means;

respective surface-engaging regions on said second and third housing sidewalls for firmly supporting said housing in a first housing position wherein said third sidewall is adjacent the support surface and said wheel is generally upright and alternately in a second housing position wherein said second sidewall is adjacent said support surface and said wheel is generally horizontal;

a substantially planar tool-supporting table; and means for connecting said table to said housing for selective movement thereof between a first table position corresponding to said first housing position and wherein said table is adjacent said generally upright wheel for tool-supporting purposes, and a second table position corresponding to said second housing position and wherein said table is shifted completely away from the generally horizontal wheel for permitting free access to the wheel without interference from said table.

2. The machine as set forth in claim 1, said connecting means including a pair of elongated, spaced arms, means pivotally mounting said arm to said third sidewall, and means connecting said table to said arms, the outermost ends of said arms remote from said third sidewall including surface-engaging means for supporting said table in said first and second table positions.

3. The machine as set forth in claim 2, said means connecting said table to said arms including a respective support extending upwardly from the outermost end of each arm.

4. The machine as set forth in claim 3 wherein said table connecting means includes structure for selectively varying the angle between said table and said wheel, when said housing and said table are in the first position thereof.

5. The machine as set forth in claim 3 wherein said table connecting means includes structure for selective lateral displacement of said table when the table and housing are in their first positions.

* * * * *